US006531818B1

(12) United States Patent
Normanni

(10) Patent No.: US 6,531,818 B1
(45) Date of Patent: Mar. 11, 2003

(54) PUMPING TUBE FOR PUMPING AND FILLING FLAT DISPLAY PANEL

(75) Inventor: Alain Normanni, Seyssins (FR)

(73) Assignee: Thomson Licensing S. A., Boulogne Cedex (FR)

( * ) Notice: Subject to any disclaimer, the term of this patent is extended or adjusted under 35 U.S.C. 154(b) by 280 days.

(21) Appl. No.: 09/614,329

(22) Filed: Jul. 12, 2000

(30) Foreign Application Priority Data

Jul. 13, 1999 (FR) ..... 99 09087

(51) Int. Cl.[7] ..... H01J 9/38

(52) U.S. Cl. ..... 313/582; 313/493; 313/495; 445/25; 445/41; 220/2.2

(58) Field of Search ..... 313/582, 495–497, 313/422, 309, 493, 484; 445/41, 25; 220/2.2

(56) References Cited

U.S. PATENT DOCUMENTS

| | | | | |
|---|---|---|---|---|
| 2,704,169 A | * | 3/1955 | Ishler | 220/2.2 |
| 3,821,584 A | | 6/1974 | Scovronek | 313/174 |
| 3,914,000 A | * | 10/1975 | Beckerman et al. | 445/25 |
| 4,770,310 A | * | 9/1988 | Morimoto et al. | 220/2.2 |
| 5,207,607 A | * | 5/1993 | Nagano et al. | 313/582 |
| 5,897,927 A | * | 4/1999 | Tsai et al. | 220/2.2 |
| 6,313,579 B1 | * | 11/2001 | Nakano et al. | 313/484 |

FOREIGN PATENT DOCUMENTS

| | | | | |
|---|---|---|---|---|
| JP | 52-050683 | | 4/1977 | H01J/7/22 |
| JP | 1-041142 | | 2/1989 | H01J/11/02 |
| JP | 2-181348 | | 7/1990 | H01J/29/86 |
| JP | 07105848 A | * | 4/1995 | H01J/9/38 |

OTHER PUBLICATIONS

*Patent Abstracts of Japan, vol. 001, No. 119, Oct. 11, 1977 and JP 52–050683.

*Patent Abstracts of Japan, vol. 014, No. 451, Sep. 27, 1990 and JP 02–181348.

*Patent Abstracts of Japan, vol. 013, No. 235, May 30, 1989 and JP 1–041142.

* cited by examiner

*Primary Examiner*—Nimeshkumar D. Patel
*Assistant Examiner*—Sikha Roy
(74) *Attorney, Agent, or Firm*—Joseph S. Tripoli; Joseph J. Laks; Carlos M. Herrera

(57) ABSTRACT

The invention proposes a pumping tube shape which makes it possible, on the one hand, to guide the pumping tube when positioning the latter on the tile and when producing the seal by heating and, on the other hand, to prevent runs inside the pumping hole. Moreover, the pumping tube of the invention makes it possible to produce an almost ideally distributed homogeneous seal, thereby ensuring that the latter seals reliably. The invention also relates to a plasma display panel having the pumping tube of the invention.

11 Claims, 3 Drawing Sheets

PUMPING TUBE FOR PUMPING AND FILLING FLAT DISPLAY PANEL

FIELD OF THE INVENTION

The invention relates to a pumping tube. More particularly, the invention relates to the pumping tube used for pumping and filling a flat display panel of the plasma display panel type.

BACKGROUND OF THE INVENTION

Plasma panels are flat display screens in which the displayed image consists of a set of light discharge points. The light discharges are produced in a gas contained between two insulating tiles, generally made of glass. Each discharge point is generated by a discharge cell defined by an intersection between arrays of electrodes carried by at least one of the tiles. The gas contained between the two tiles is generally a gas mixture which emits visible or invisible radiation when a discharge is produced. To obtain sufficient light emission, it is necessary to have a gas or gas mixture as pure as possible.

Pumping tubes are used for evacuating and then filling plasma display panels. Conventionally, the pumping tubes are made of glass so as to be sealed onto one tile of the panel, this tile having been provided beforehand with a hole. The pumping tube is mounted after the two tiles forming the panel have been joined together.

FIG. 1 shows a pumping tube 1 according to the prior art, which comprises a tubular part 2, for carrying out the pumping, and a plane part 3 intended to bear on one face of the tile of the panel.

To be able to seal the pumping tube 1 onto the panel, a bead 4 of glass paste is placed on the plane part 3, as shown in FIG. 2. The glass paste is a mixture consisting of a glass frit and an organic resin.

After the bead 4 has been deposited, the pumping tube 1 is positioned on the rear tile 5 of the panel and held in place by means of a clip 6, as shown in FIG. 3. The pumping tube 1 is positioned so that it faces a hole 7.

The panel is then heated to a temperature of between 400° C. and 550° C. so as to melt the glass frit and completely burn off the resin of the paste forming the bead 4.

After localized heating, the bead 4 is converted into an impermeable seal 8. FIG. 4 shows an ideal case of a seal for the pumping tube 1 facing the hole 7. Unfortunately, in reality, many problems arise when positioning the pumping tube 1 and when producing the seal 8. Thus, one or more of the defects shown in FIG. 5 may be encountered.

A first defect is an axial offset 9 between the hole 7 and the pumping tube 1. The axial offset has the effect of reducing the pumping area. This defect occurs when positioning the clip 6.

A second defect is an angular offset 10 with respect to the perpendicular. The angular offset 10 causes non-uniform flattening of the sealing bead, which is manifested in a sealing problem.

A third defect consists of runs 11 of sealing material in the hole 7. This defect is magnified by the angular offset. The main drawback of the runs is a reduction in the pumping orifice and therefore an increase in the pumping time.

Most of these defects may be minimized by greater and expensive precision in positioning the various elements involved in placing the pumping tube 1 on the tile 5.

BRIEF DESCRIPTION OF THE INVENTION

The invention proposes to remedy the various problems mentioned by reducing the precision needed for mounting the pumping tube. The invention proposes a pumping tube shape which makes it possible, on the one hand, to guide the pumping tube when positioning the latter on the tile and when producing the seal by heating and, on the other hand, to prevent runs inside the pumping hole. Moreover, the pumping tube of the invention makes it possible to produce an almost ideally distributed homogeneous seal, thereby ensuring that the latter seals reliably.

The subject of the invention is a pumping tube for a flat display panel, which pumping tube comprises a plane part intended to bear on an external plane of a tile of the said panel, in order to be sealed thereto, and comprises a tubular part which extends perpendicular to the plane part, the said tubular part being intended to fit into a hole in the tile.

The invention also relates to a plasma display panel comprising two tiles bonded together and forming a cavity, one of the two tiles being provided with a hole making it possible to create a vacuum in the cavity and then to fill the cavity with a gas, and a pumping tube comprising a plane part sealed around the hole, which pumping tube comprises a tubular part which extends perpendicular to the plane part, the said tubular part being inside the hole.

BRIEF DESCRIPTION OF THE DRAWINGS

The invention will be more clearly understood and further features and advantages will appear on reading the description which follows, the description referring to the appended drawings among which.

DESCRIPTION OF A PREFERRED EMBODIMENT

Figure 1:
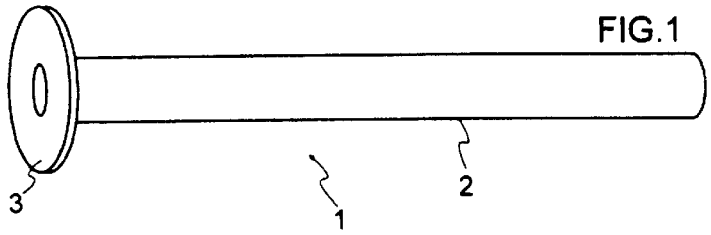
FIG. 1 shows a pumping tube according to the prior art.
Figure 2:
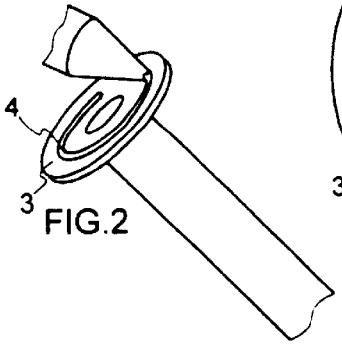
FIGS. 2 to 5 show the steps in mounting a pumping tube according to the prior art on a plasma display panel.
Figure 3:
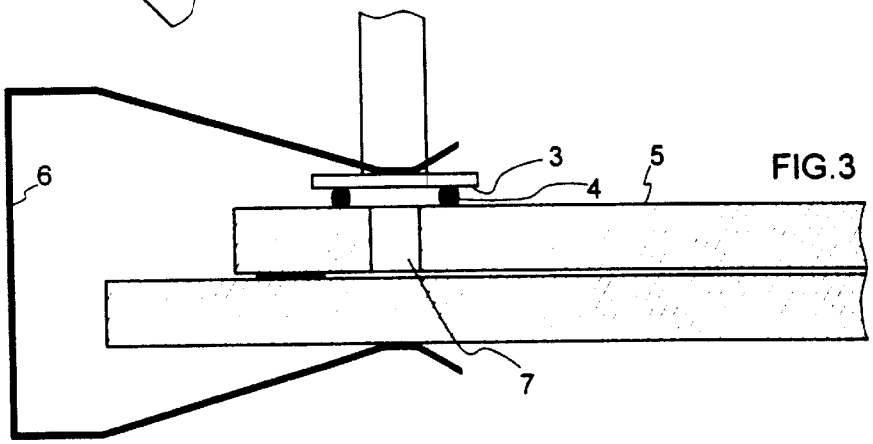
Figure 4:
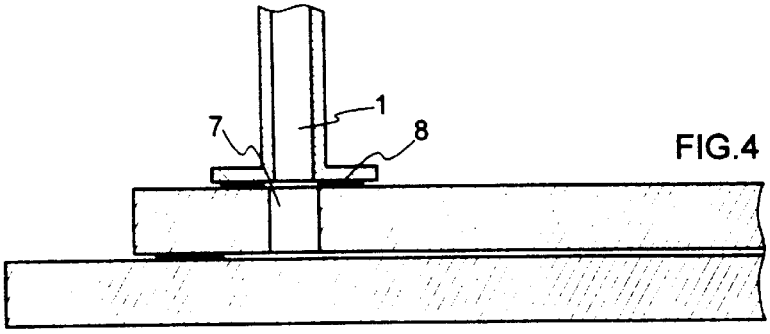
Figure 5:
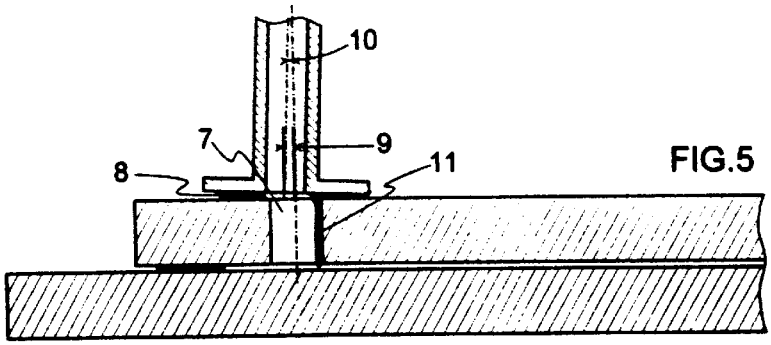
Figure 6:
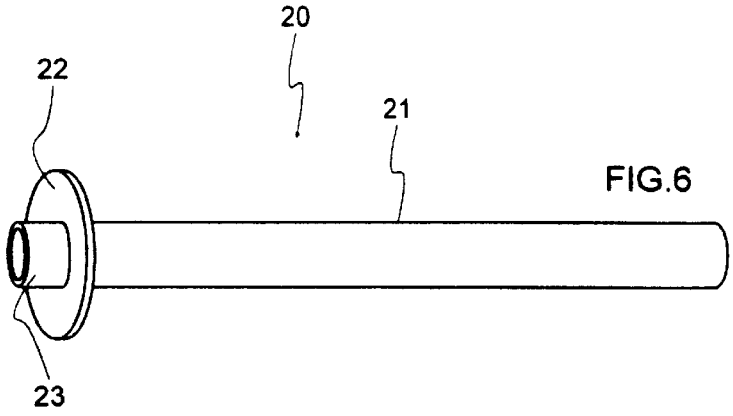
FIG. 6 shows a pumping tube according to one embodiment of the invention.

FIG. 6 shows a pumping tube 20 according to a preferred embodiment of the invention. This pumping tube is essentially made of glass and comprises:

a first tubular part 21 intended to be connected to a vacuum pump;

a plane part 22 intended to bear on the tile of the panel so as to seal the pumping tube onto the said tile; and a second tubular part 23 which is intended to fit into the hole in the tile and extends perpendicular to the plane part.

The second tubular part provides, on the one hand, a guiding function, by guiding the pumping tube with respect to the tile which supports it, and, on the other hand, a seal edge function.

Figure 7:
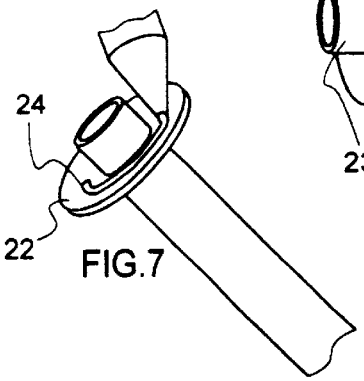
FIGS. 7 to 11 show the steps in mounting a pumping tube according to one embodiment of the invention on a plasma display panel.
Figure 8:
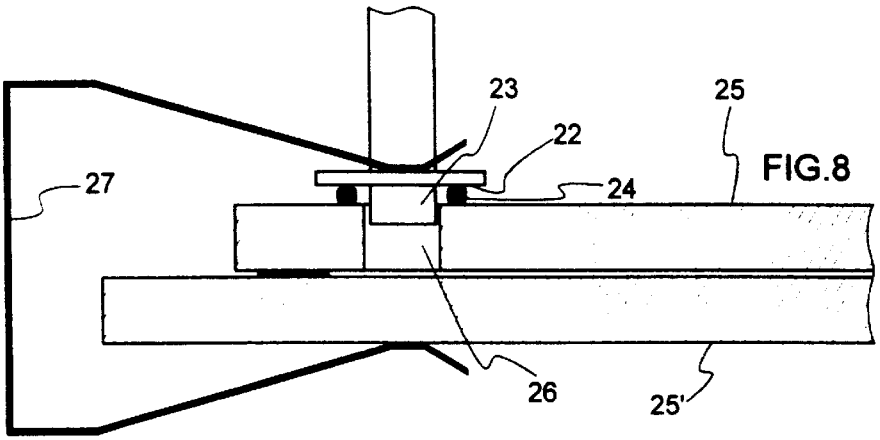

Such a pumping tube 21 is mounted by depositing a bead 24 on the plane part 22, as shown in FIG. 7. Compared with the prior art, the bead 24 may be greater in volume and be placed relatively imprecisely. The glass-frit paste of which the bead is composed may use a more fluid resin, which allows the bead 24 to be deposited more quickly. This is because the presence of the second tubular part prevents the paste from being accidentally deposited inside the pumping tube.

Next, the pumping tube 20 is. positioned on one of the two tiles 25 and 25' of a plasma display panel, the second tubular part 23 being loosely fitted into a hole 26 produced beforehand in the tile 25. Next, a clip 27 is put into place in order to hold the pumping tube 20 against the tile 25 and to flatten the bead 24 during a heating step which converts the bead 24 into a seal.

Various functions are to be taken into account when determining the dimensions of the pumping tube. In order to be able to guide the latter, it is necessary to have, on the one hand, a long enough length of the second tubular part 23 and, on the other hand, a small enough gap between the tubular part 23 and the hole 26. In order to allow the pumping tube to be mounted without any force, it is necessary to have, on the one hand, a sufficiently short length of the second tubular part and, on the other hand, a sufficiently large difference between the external diameter of the second tubular part 23 and the diameter of the hole 26. It is also necessary to have a length of the second tubular part 23 which is longer the wider the gap between the second tubular part 23 and the hole 26 so as to limit any flow of molten glass by capillary effect to a distance of less than the length of the tubular part 23. Preferably, the length of the second tubular part 23 is between one half of the thickness of the tile 25 and the thickness of the tile 25 and the difference between the external diameter of the second tubular part 23 and the diameter of the hole is between 50 and 300 $\mu$m.

The second tubular part 23 fitted into the hole 26 and the plane part 22 bearing on the tile around this hole cooperate in order to position the pumping tube 20 easily and precisely; advantageously, the width of the bearing surface of the plane part 22 extending beyond the tubular part is at least equal to the depth of penetration into the hole 26 of the second tubular part 23; this is equivalent to saying that half the difference between the external diameter of this plane part 22 and the diameter of the hole is at least equal to the said depth of penetration of the second tubular part 23. The shape and the dimensions of the pumping tube 20 thus defined make it possible to limit the forces to be applied to this pumping tube in order to hold it in position and to seal it, thereby limiting the risks of breaking this piece, generally made of glass.

Figure 9:
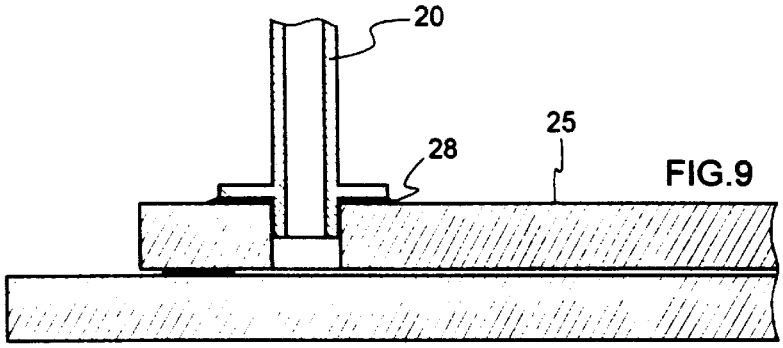

After the heating step, during which the bead 24 liquefies, a perfect and gastight seal 28 is obtained between the pumping tube 20 and the tile 25, as shown in FIG. 9. The process then continues with a vacuum pumping step followed by a step of filling the panel with a gas mixture, for example a mixture of argon and neon. The panel is filled until a pressure below atmospheric pressure is obtained, for example approximately $5\times10^4$ pascals (500 millibar).

Figure 10:
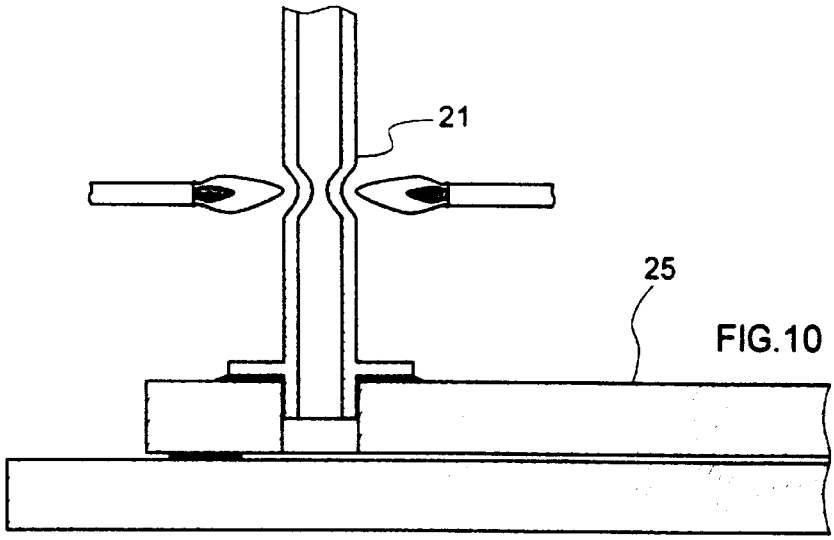
Figure 11:
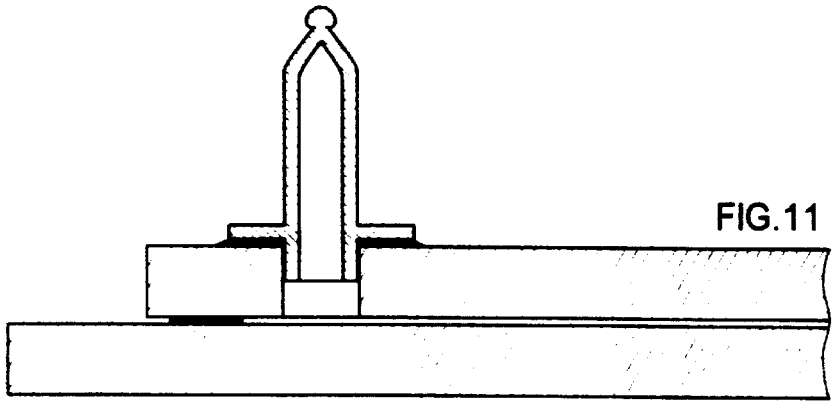

The first tubular part 21 is then heated locally, for example at a distance of approximately 1 to 2 cm from the tile 25, until it softens, as shown in FIG. 10. Due to the difference in pressure between the inside and the outside of the pumping tube, the first tubular part narrows down locally until it is completely closed off, as shown in FIG. 11. In order to achieve closure, it is necessary to have a wall thickness of the first tubular part 21 large enough to be able to deform without being punctured. Conventionally, a thickness preferably 25% greater than the internal diameter, for example a thickness of about 1 mm for an internal diameter of 3 mm, is used.

Figure 12:
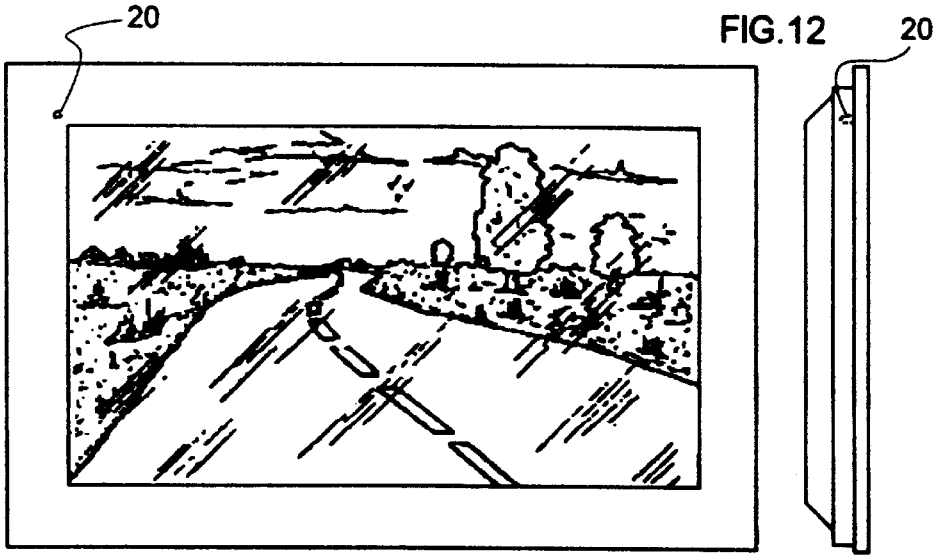
FIG. 12 shows, in front and side view, a plasma panel having a pumping tube according to one embodiment of the invention.

Next, the plasma display panel is mounted in a frame with its electronic drive circuits. The pumping tube 20 is then concealed in the frame, generally in one corner of the said panel, as shown in FIG. 12, which illustrates a plasma display panel with its frame, in front view and in side view.

Of course, many variants of the invention are conceivable without departing from the scope of the invention. In particular, the mouth of the first tubular part, which is intended to be connected into the pumping and filling machine, may have a shape completely different from that shown in FIG. 6. By way of example, this mouth may be flared so as to correspond to the mouth of the machine.

Likewise, the example described relates to a plasma display but it goes without saying that the invention can be transposed to other types of flat screens which use glass tiles and have to be vacuum-pumped and possibly filled with another gas.

What is claimed:

1. Pumping tube for a flat display panel, which pumping tube comprises:

a plane part intended to bear against an external plane of a tile of the panel, in order to be sealed thereto, and a tubular part which extends perpendicular to the plane part and is intended to fit into a hole in the tile wherein half the difference between the external diameter of the plane part and the diameter of the hole is at least equal to the depth to which the second part is intended to fit into the hole.

2. Pumping tube according to claim 1 which is essentially made of glass.

3. Pumping tube according to claim 1, wherein the tubular part extends from the plane part over a length less than or equal to the thickness of the tile and greater than one half of the thickness of the tile.

4. Pumping tube according to claim 3 which is essentially made of glass.

5. Pumping tube according to claim 1, wherein the tubular part extends from the plane part over a length less than or equal to the thickness of the tile and greater than one half of the thickness of the tile.

6. Pumping tube according to claim 5 which is essentially made of glass.

7. Pumping tube according to claim 1, wherein the difference between the diameter of the hole and the external diameter of the tubular part is small enough to limit any flow of molten glass to a distance of less than the length of the tubular part.

8. Plasma display panel comprising:

two tiles bonded together and forming a cavity, one of the two tiles being provided with a hole making it possible to create a vacuum in the cavity and then to fill the cavity with a gas;

a pumping tube comprising a plane part sealed around the hole and the tubular part which extends perpendicular to the plane part and is fitted into the hole, wherein one half of the difference between the external diameter of the plane part and the diameter of the hole is at least equal to the depth to which the second part fits into the hole.

9. Panel according to claim 8, wherein the pumping tube is essentially made of glass.

10. Panel according to claim 8, wherein the tubular part extends from the plane part over a length less than or equal to the thickness of the tile and greater than one half of the thickness of the tile.

11. Panel according to claim 10, wherein the difference between the diameter of the hole and the external diameter of the tubular part is small enough to limit any flow of molten glass to a distance of less than the length of the tubular part.

* * * * *